US010297176B1

(12) United States Patent
Puett, III

(10) Patent No.: US 10,297,176 B1
(45) Date of Patent: May 21, 2019

(54) HAND-HELD SWINGING BANNER WITH INTEGRAL CONTAINER AND NOISE MAKER

(71) Applicant: ULTRA SPORT PRODUCTS, LLC, City of Industry, CA (US)

(72) Inventor: Ralph Thomas Puett, III, Highland, CA (US)

(73) Assignee: ULTRA SPORT PRODUCTS, LLC, City of Industry, CA (US)

( * ) Notice: Subject to any disclaimer, the term of this patent is extended or adjusted under 35 U.S.C. 154(b) by 0 days.

(21) Appl. No.: 15/951,000

(22) Filed: Apr. 11, 2018

(51) Int. Cl.
*G09F 17/00* (2006.01)
*G09F 21/02* (2006.01)
*G10K 3/00* (2006.01)

(52) U.S. Cl.
CPC ..... *G09F 17/00* (2013.01); *G09F 21/02* (2013.01); *G10K 3/00* (2013.01)

(58) Field of Classification Search
CPC ..... G09F 21/00; G09F 21/026
USPC ..... 40/218, 586, 604; 116/174
See application file for complete search history.

(56) References Cited

U.S. PATENT DOCUMENTS

| | | | | |
|---|---|---|---|---|
| 6,155,197 | A * | 12/2000 | Stanley | G09F 17/00 116/173 |
| 9,044,687 | B2 * | 6/2015 | Walker | A63H 37/00 |
| 2005/0098084 | A1 * | 5/2005 | Puett, III | G09F 17/00 116/173 |
| 2011/0028065 | A1 * | 2/2011 | Arcovio | A63H 37/00 446/242 |
| 2011/0173851 | A1 * | 7/2011 | Cohen | G09F 19/02 40/218 |
| 2013/0205625 | A1 * | 8/2013 | Pilok | G09F 17/00 40/218 |
| 2014/0273720 | A1 * | 9/2014 | DiNunzio | A63H 37/00 446/266 |

* cited by examiner

*Primary Examiner* — Joanne Silbermann

(57) ABSTRACT

A swinging banner display having a tube handle that doubles as a container for the banner when not being displayed. The banner is attached to a rod which is rotatably attached to the tube handle. The tube handle is sized to fit within a hand but large enough to hold the banner, shaft and disc when the banner is furled. A rotatable disc inside the tube handle has a knob on the perimeter that engages with ribs on the inside of the tube handle to make a rattling noise when the banner is rotated.

2 Claims, 11 Drawing Sheets

HAND-HELD SWINGING BANNER WITH INTEGRAL CONTAINER AND NOISE MAKER

BACKGROUND OF THE INVENTION

1. Field of the Invention

The present invention relates generally to improvements in banners and more particular pertains to new and improved hand-held banners used at sporting events.

2. Description of Related Art

In the field of banner displays it has been a practice to employ fixed frames for the banners, or to simply wave the banner about without any frame. Packaging of banners to facilitate sale to customers involves additional expense. The packaging is discarded subsequent to purchase of the banner. This practice has been unsatisfactory in that it increases cost to the consumer and it does not provide the consumer a convenient method of storing the banner for future use.

SUMMARY OF THE INVENTION

The swinging banner display of the present invention utilizes a tube that doubles as a handle and a container allowing the banner to be stored in the tube handle when not in use. The banner is attached to a shaft which is rotatably attached to the tube. The tube is sized to fit within a hand but yet large enough to hold the banner and shaft when the banner is furled for storage. A rotatable disc inside the tube has a knob on its perimeter that engages with ribs on the interior of the tube to make a rattling noise when the banner is rotated by swinging the handle in a circle causing the disc to rotate inside the tube.

BRIEF DESCRIPTION OF THE DRAWINGS

The exact nature of this invention as well as its advantages will be readily appreciated as the same becomes better understood by reference to the following detailed description when considered in conjunction with the accompanying drawings in which like reference numerals designate like parts throughout the figures thereof and wherein.

DETAILED DESCRIPTION OF THE INVENTION

Figure 1:
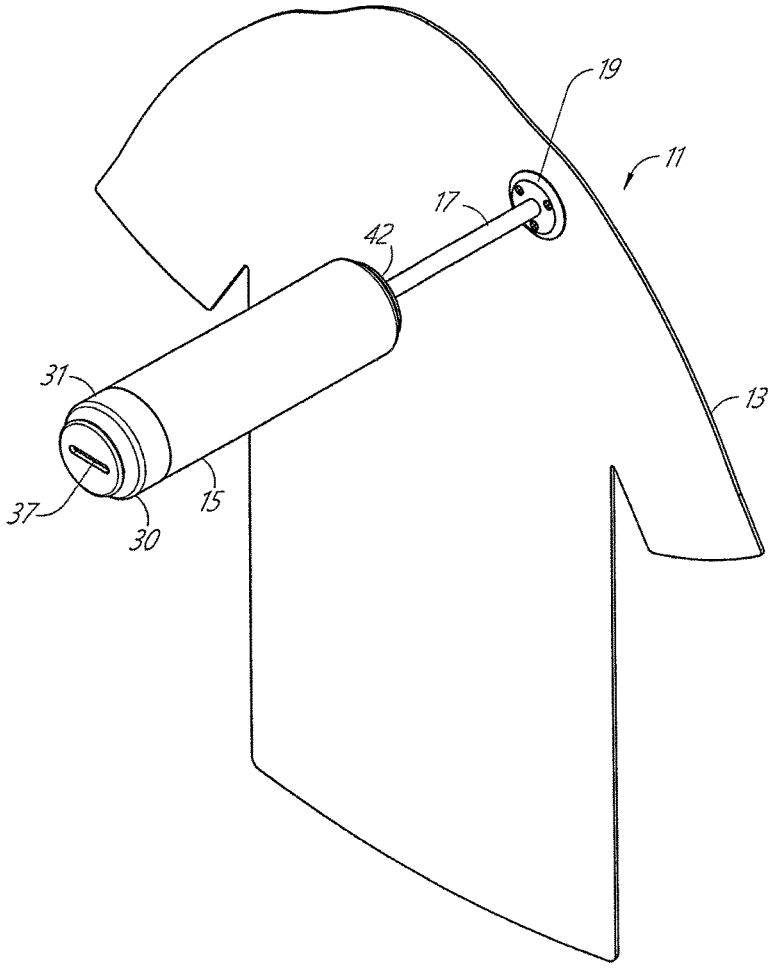
FIG. 1 is a front perspective of the hand-held swinging banner invention.

FIG. 1 shows the hand-held swinging banner invention 11 illustrated in perspective showing a banner 13 in the form of a team jersey. It should be understood that the banner 13 may be any other shape of convenient choice such as a flag, a towel, or a similar demonstrative cloth. The banner 13 is attached to a disc 19 which is permanently fixed to the first end of a rod 17. The rod 17 is inserted into the tube handle 15 at a first end 42. The second end 30 of the tube handle 15 is closed by a cap 31 having a slot 37 through its symmetrical center.

Figure 2:
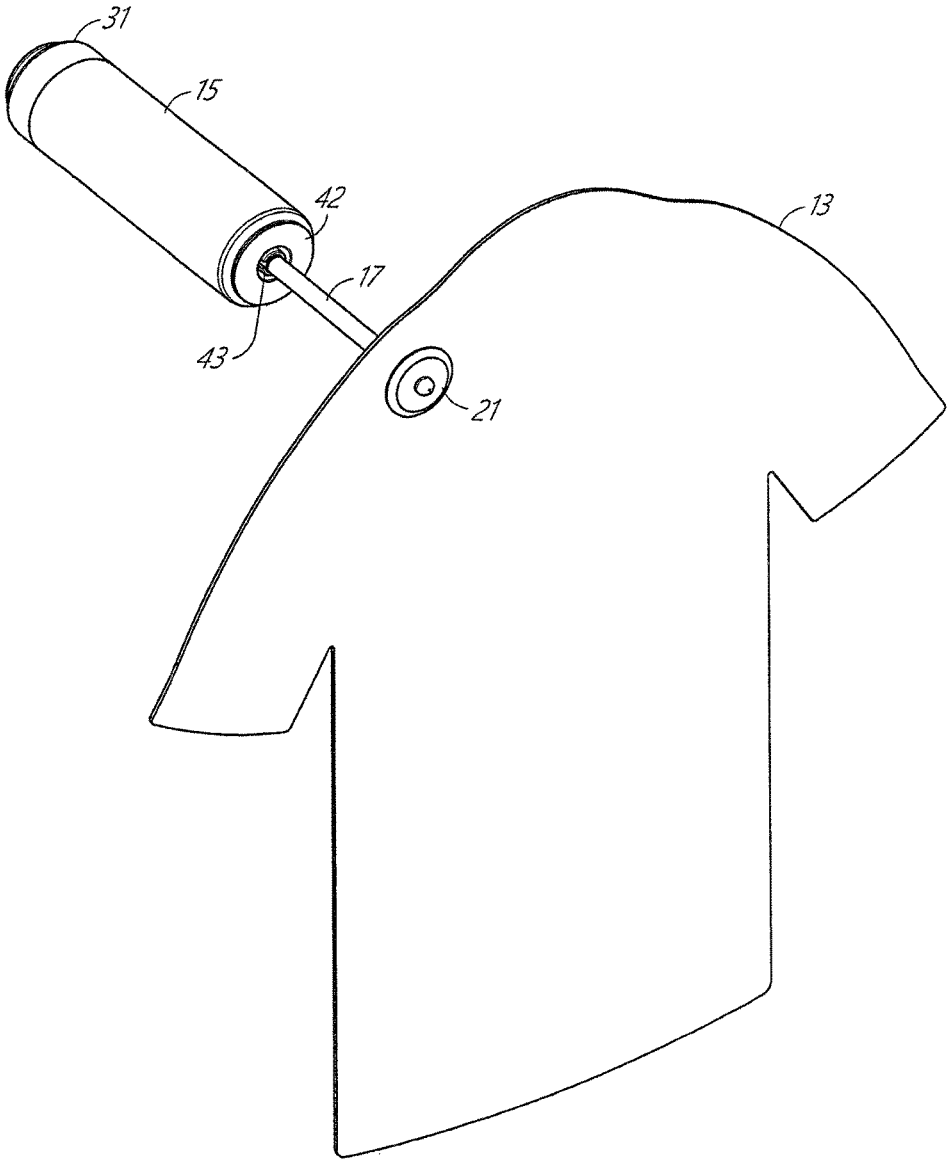
FIG. 2 is a back perspective of the hand-held swinging banner invention

FIG. 2 illustrates the back view of the assembly shown in FIG. 1. The banner 13 is clamped by a disc 21 on the back side and the disc 19 on the front side (FIG. 1). The shaft 17 is attached to the disc 19 at its first end. The second end of the shaft goes through an aperture 43 at the closed first end 42 of the tube 15. The second end 30 of the tube 15 is capped by the cap 31.

Figure 3:
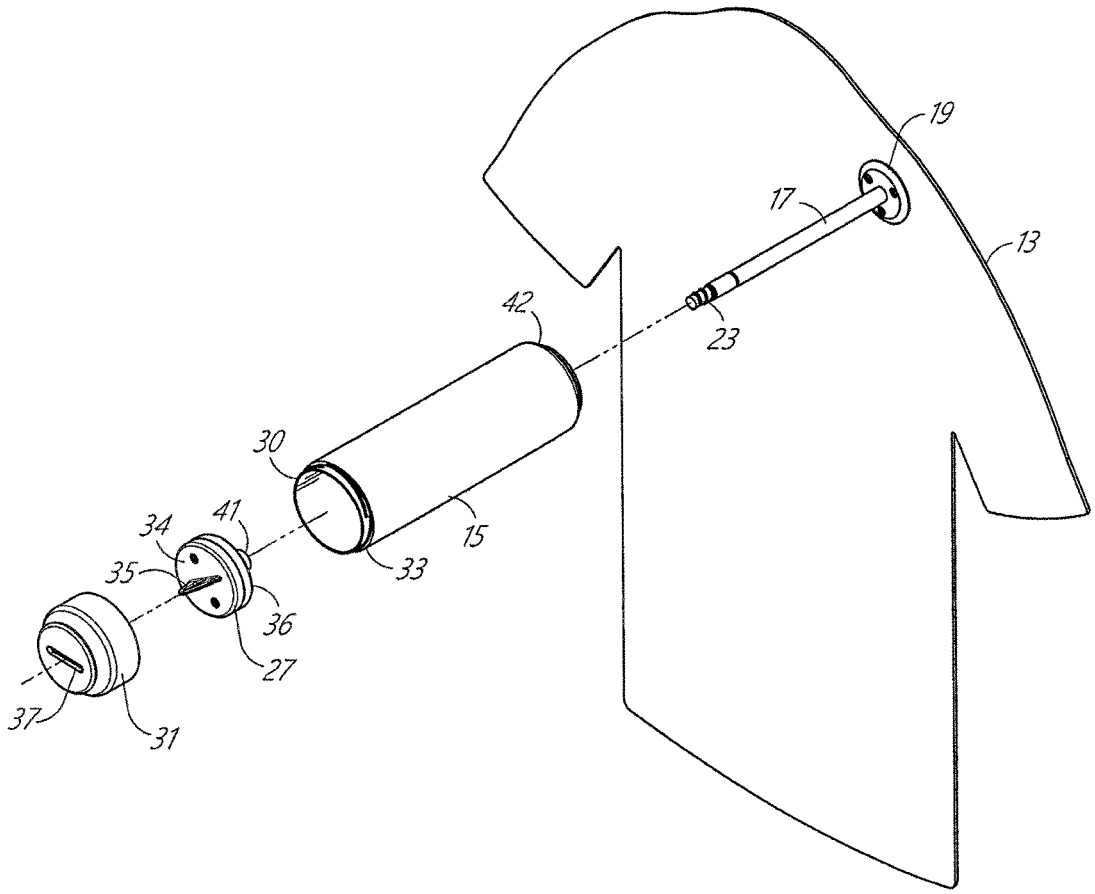
FIG. 3 is a front assembly drawing of the swinging banner.

FIG. 3 shows all the parts of the invention in assembly. The banner 13 is permanently attached by disc 19 at the front side to the first end of rod 17. Rod 17 is shown outside of the tube 15 having a threaded second end. The tube 15 has threads 33 at the first end. A disc 27 of a diameter slightly smaller than the diameter of the tube 15 has a boss 41 on the second side at its symmetrical center with internal threads which attaches to the threaded end 23 of the rod 17. The first side 34 of disc 27 has a fin 35 attached thereto through the symmetrical center of the disc 27. The cap 31 attaches to the open end 30 of the tube 15 by threads 33. The cap has a slot 37 through its symmetrical center sized to receive the fin 35.

Figure 4:
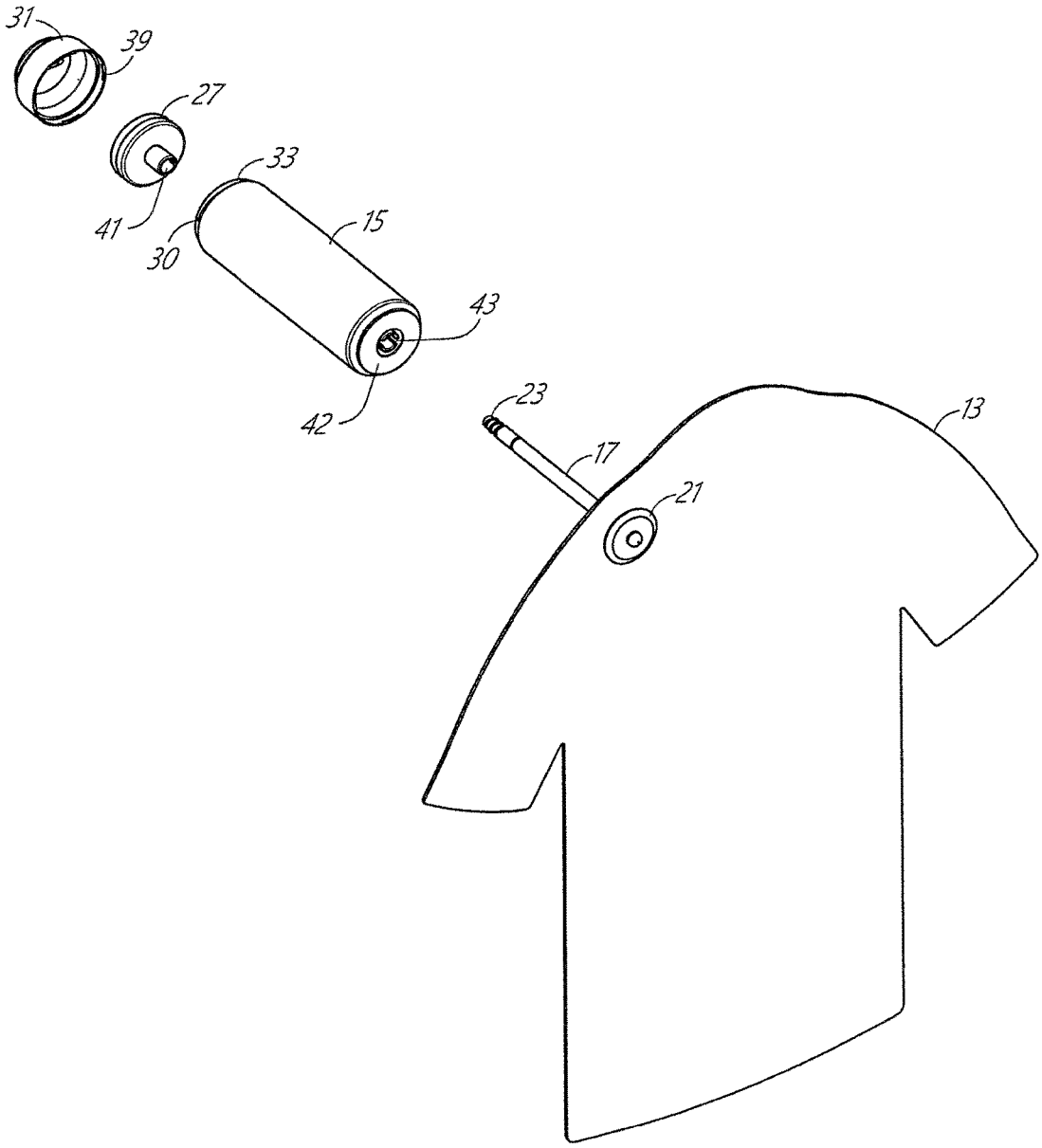
FIG. 4 is a back assembly drawing of the swinging banner.

FIG. 4 illustrates the back side of FIG. 3. The rod 17 passes through aperture 43 in the first end 42 to threadably attach to the internal threads of boss 41 on the disc 27. The threads are preferably reverse threads so that rotating the banner 13 in a clockwise direction will not unthread the rod 17 from the disc. The cap 31 has internal threads 39 which threadably fasten to second end 30 of tube 15 by external threads 33 on the tube end 30.

Figure 5:
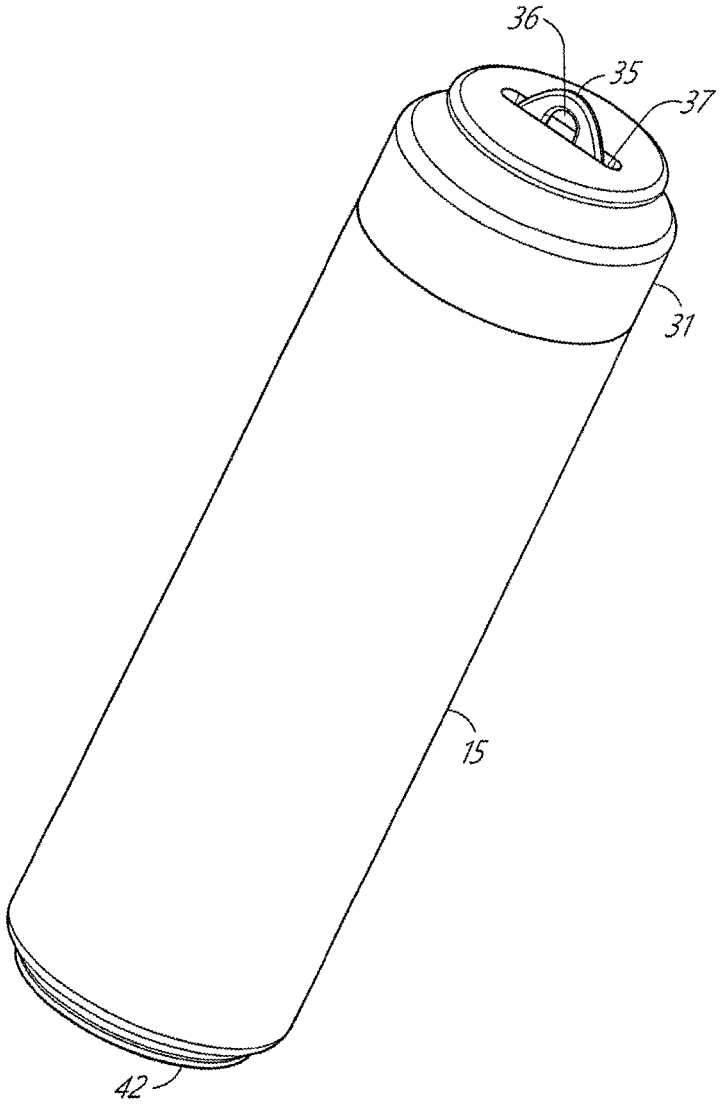
FIG. 5 is a bottom perspective of the swinging banner assembled in the tube.

FIG. 5 illustrates the tube 15 containing the banner 13, rod 17 and disc 17 in a tube-like package.

The banner 13 is furled around the rod 17 and inserted into the tube 15 with the disc 27 so that the fin 35 passes through the slot 37 in end cap 31. The fin 35 preferably has an aperture 36 therein to facilitate display or storage on a hook.

Figure 6:
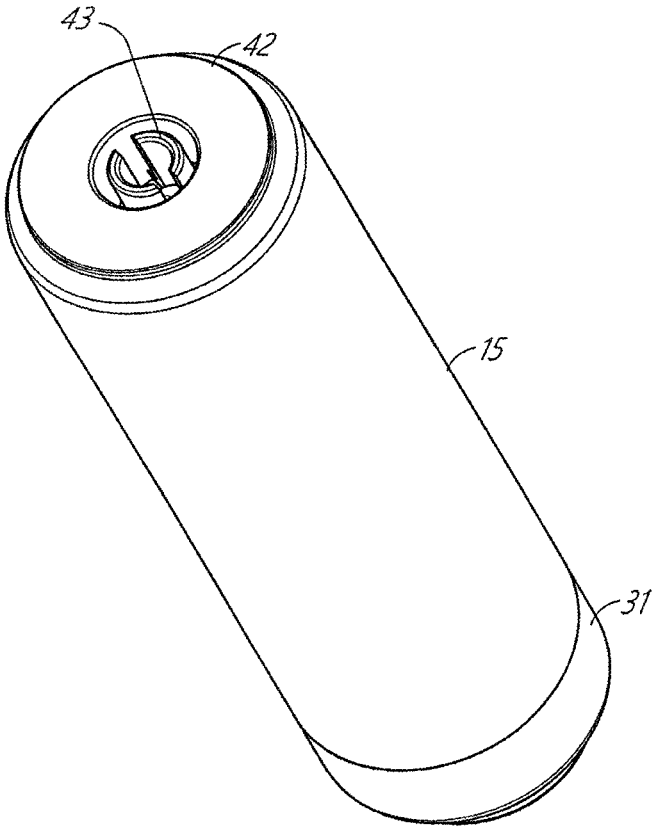
FIG. 6 is a top perspective of the FIG. 5.

FIG. 6 illustrates the tube 15 showing the closed end 42 of the tube 15 having an aperture 43 sized in diameter to receive the rod 17.

Figure 7:
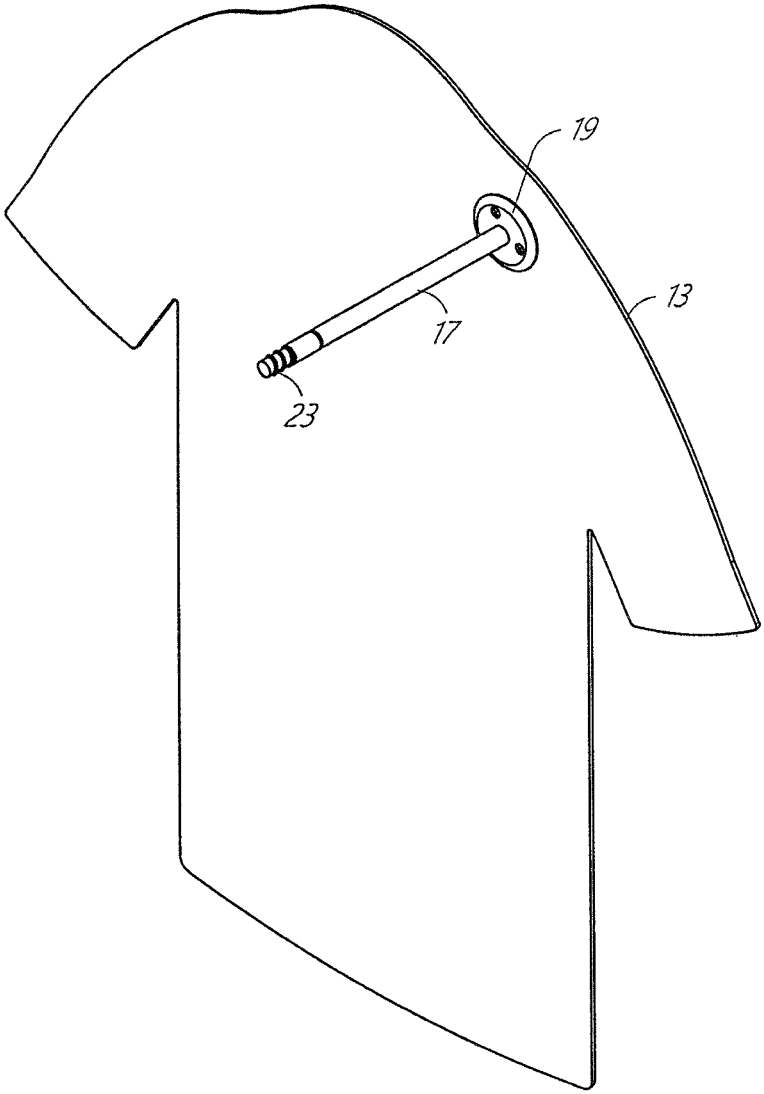
FIG. 7 is a front perspective of the shaft and its connection to the banner.
Figure 8:
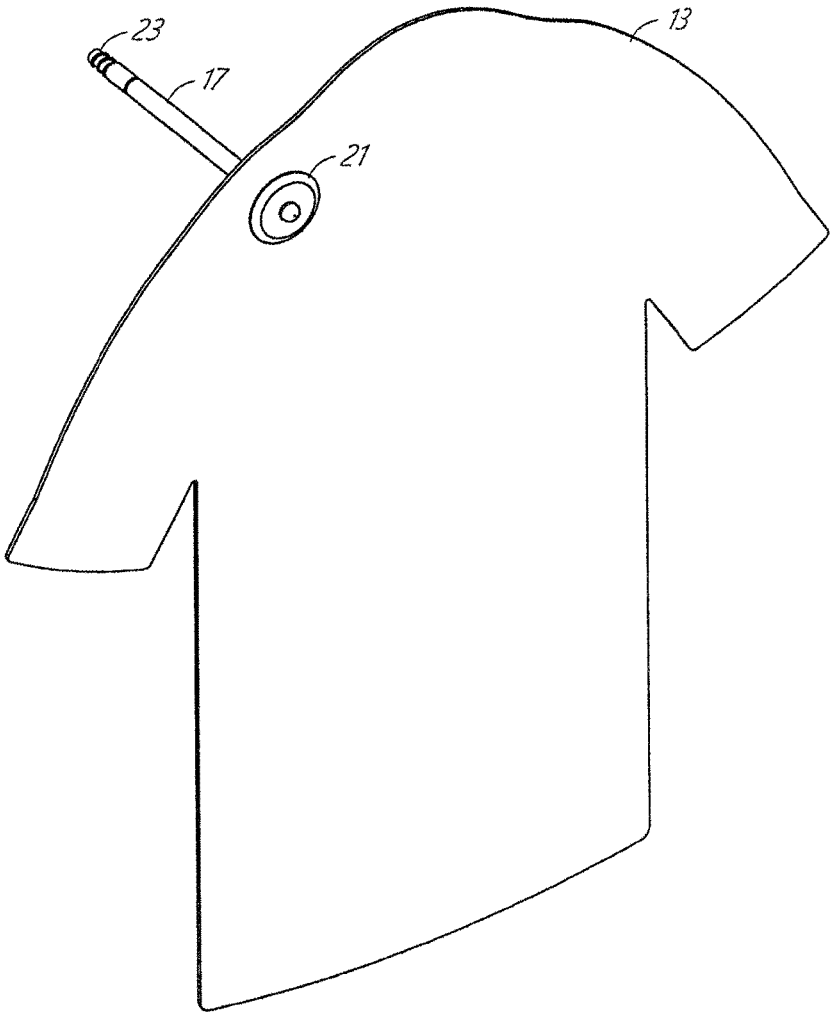
FIG. 8 is a back perspective of the shaft and its connection to the banner.

FIGS. 7 and 8 illustrate the banner 13 fixedly fastened at a strategic location on the banner to the rod 17 by being clamped between the disc 19 on the front side, and the disc 21 on the back side. The rod 17 has a threaded end 23 for removable attachment to the disc 27 inside the tube.

Figure 9:
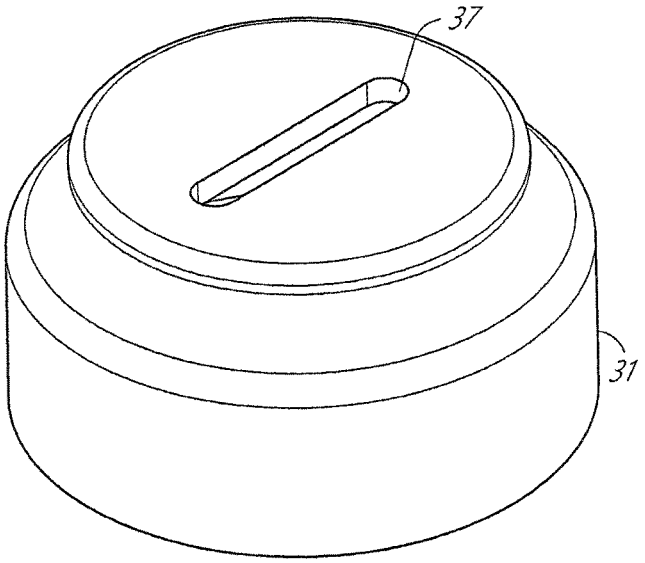
FIG. 9 is a top perspective of the end cap of the container.
Figure 10:
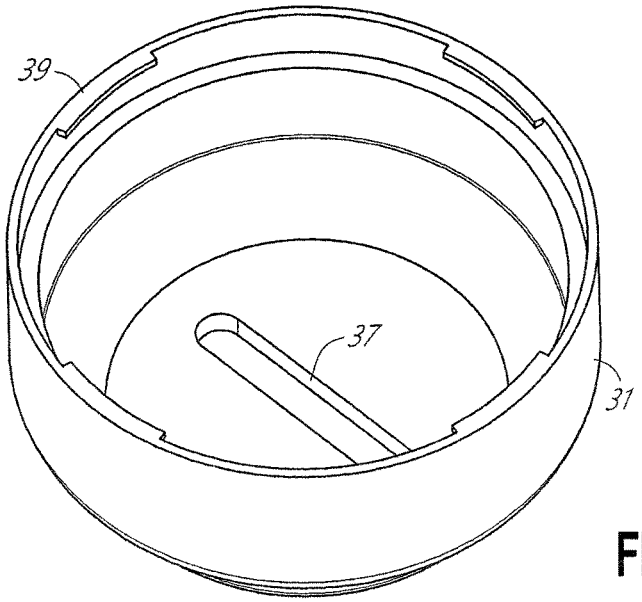
FIG. 10 is a bottom inside view perspective of the cap of FIG. 9.
Figure 11:
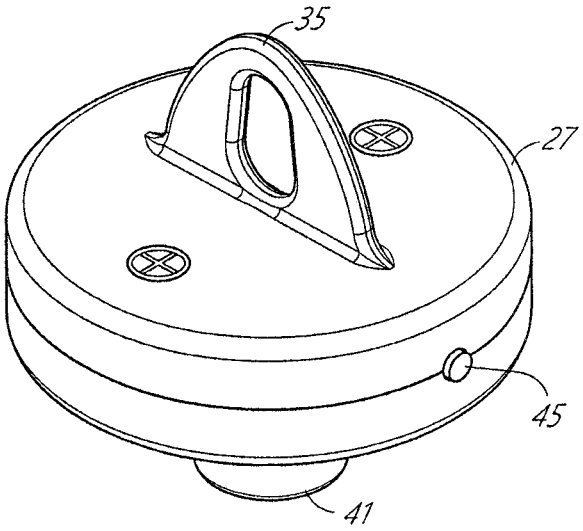
FIG. 11 is a top perspective of the disc inside the container.
Figure 12:
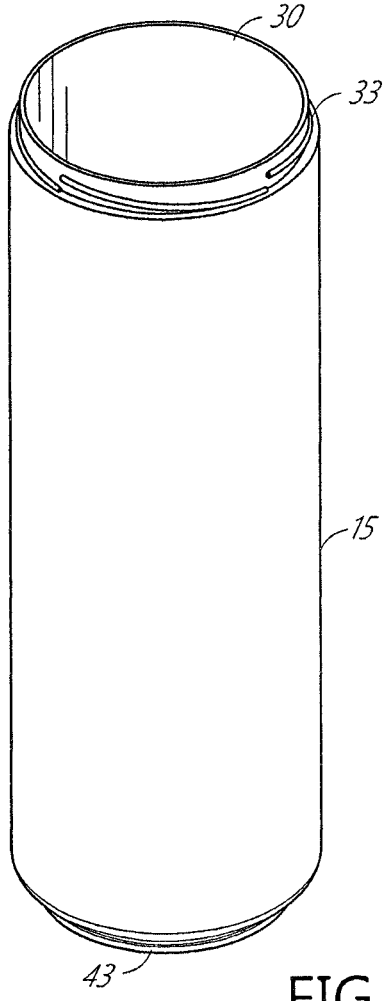
FIG. 12 is a front perspective of the tube.
Figure 13:
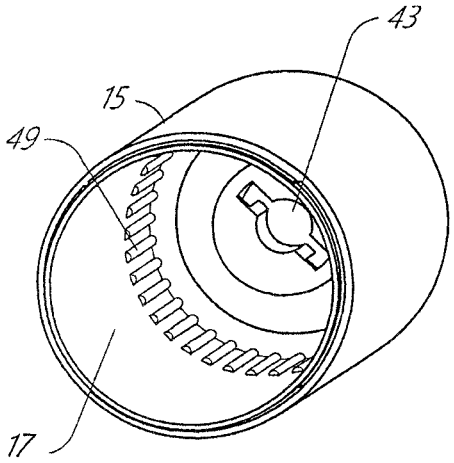
FIG. 13 is a bottom-end view perspective of the tube.

FIGS. 9 and 10 illustrate the cap 31 which threadably engages the threads 33 on the first end of the tube 15 by internal threads 39. The cap 31 is screwed on and screwed off threads 33 (FIG. 12) at the first end 30 of tube 15. The closed end of the tube 15 has an aperture 43 through its symmetrical center more clearly shown in FIG. 13, for receiving the shaft attached to the banner. A series of ribs 49 are located on the interior 47 of the tube 15. When the banner is assembled as shown in FIG. 1, the knob 45 on disc 27 engages the ribs 49. When the tube 15 is swung in a circle, the disc 27 will rotate causing the knob 45 to rub against the ribs 49 in the interior 47 of tube 25 causing a rattling sound.

What is claimed is:

1. A swinging banner, comprising:

a banner;

a rod having a first end and a second end;

a first disc fixedly attached to the first end of the rod and the banner;

a tube having a diameter with a hollow interior, open at a first end and closed at a second end, an aperture sized to receive the rod in the closed second end, the tube having ribs at a predetermined location in the interior;

a second disc, having a diameter and a first and second side, the diameter of the disc sized to fit within the tube and revolve therein, the second disc threadably attached to the second end of the rod at the second side, the second disc having a knob on its perimeter for engaging the ribs in the tube, during rotation;

wherein the tube is sized to contain the banner, attached rod and first and second disc when the banner is furled around the rod; and a cap threadably attachable to the tube at the first end when the banner is contained in the tube, the cap having a slot therein through its symmetrical center.

2. The swinging banner of claim 1 wherein the second disc has a fin extending perpendicular to the surface of the first side, the fin sized to fit within the slot in the cap when the cap is threadably attached to the first end of the tube.

* * * * *